US006416452B1

(12) United States Patent
Meyer

(10) Patent No.: US 6,416,452 B1
(45) Date of Patent: Jul. 9, 2002

(54) METHOD OF PRODUCING MUTLIWALL PLASTIC BAGS, ESPECIALLY TIE BAGS

(75) Inventor: Armin Meyer, Köln (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 0 days.

(21) Appl. No.: 09/415,737

(22) Filed: Oct. 12, 1999

(30) Foreign Application Priority Data

Oct. 14, 1998 (DE) ..... 198 47 321

(51) Int. Cl.[7] ..... B31B 1/82

(52) U.S. Cl. ..... 493/210; 493/217; 493/224; 493/922

(58) Field of Search ..... 493/210, 211, 493/217, 196, 227, 409, 922

(56) References Cited

U.S. PATENT DOCUMENTS 3,082,585 A 3/1963 Waters
4,273,549 A * 6/1981 Pezzana et al.
4,481,669 A 11/1984 Pezzana et al.
5,273,514 A * 12/1993 Kristensen
6,139,482 A * 10/2000 LaFleur

FOREIGN PATENT DOCUMENTS

DE 1 240 726 5/1967
DE 44 33 582 A1 3/1996

* cited by examiner

*Primary Examiner*—Eugene Kim
(74) *Attorney, Agent, or Firm*—Herbert Dubno

(57) ABSTRACT

A method of making multiwall plastic bags wherein half-width foil webs are unwound from respective rolls below a segment of a path within which a multilayer full-width web is guided. The half-width webs can be slit and unfolded or simply unfolded to form full-width single-layer webs which are combined by superimposition to form the multilayer full-width web. The latter is folded and the folded multilayer width is formed into the bags.

11 Claims, 3 Drawing Sheets

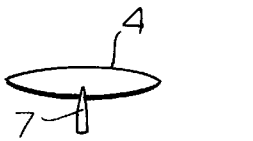
FIG.3
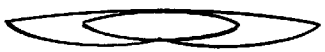
FIG.4
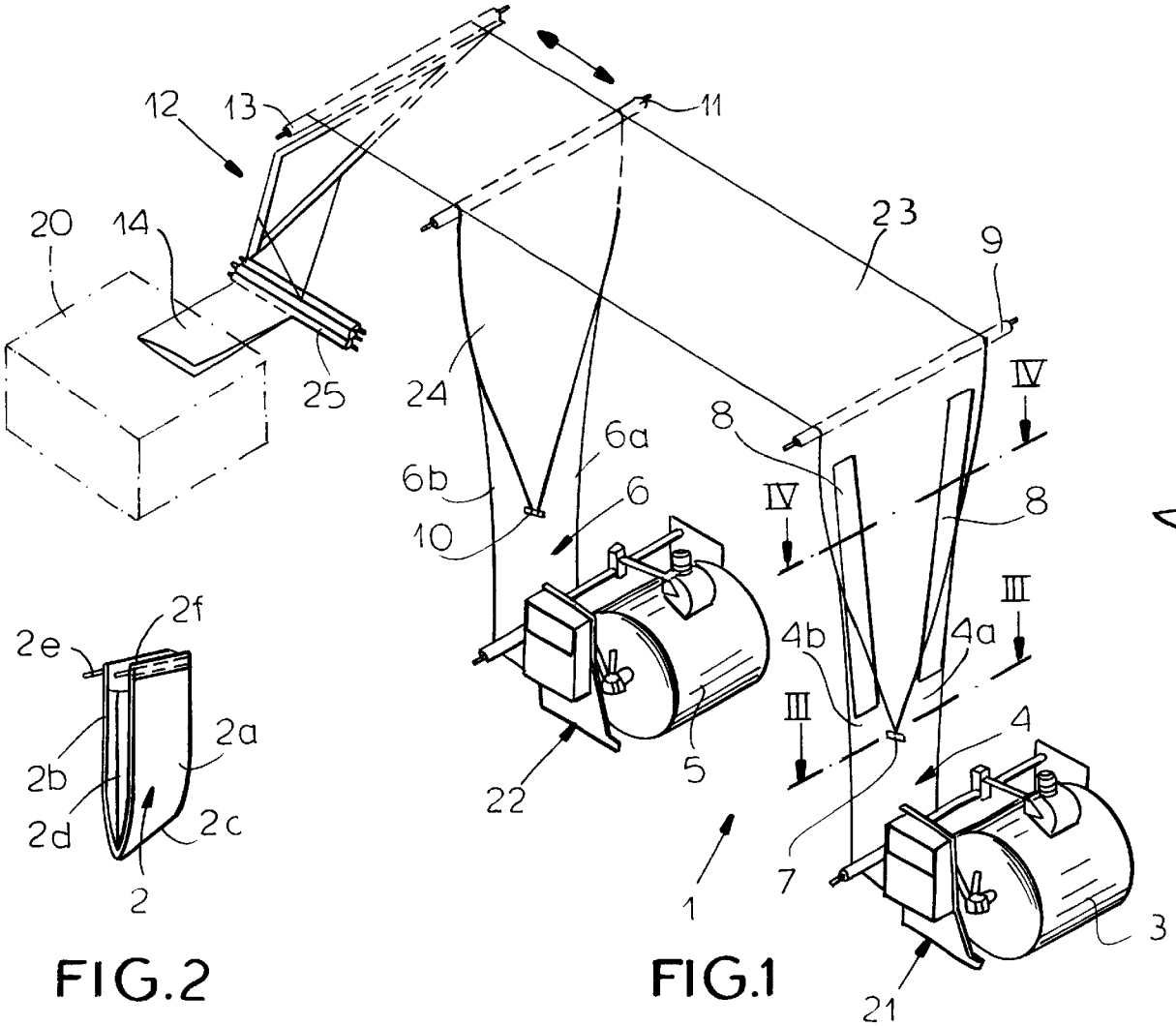
FIG.1
FIG.2

METHOD OF PRODUCING MUTLIWALL PLASTIC BAGS, ESPECIALLY TIE BAGS

FIELD OF THE INVENTION

My present invention relates to a method of making multiwall, preferably double wall, plastic bags and especially tie bags, i.e. bags having a strip which can be pulled to close the mouth of the bag. More particularly, the invention relates to a method wherein a continuous foil web is fed from an unwinding station and is constituted from thermoplastic synthetic resin.

BACKGROUND OF THE INVENTION

German patent document DE 44 33 582 describes the production of a double-wall plastic bag in which two flat foil webs are drawn from respective rolls at unwinding stations, the foil webs are superposed so that they are coextensive, thereby forming a double layer web. The double layer web is then folded into a kind of U and at an open head region, grip holes are formed by a stamping or punching process and between the outer layer and the inner layer a pull strip is inserted to form the tie of the bag. The layers of the web are then welded together at the head region in pairs and lateral weld seams can then be provided and the web with the bags formed therein can be perforated to allow separation of the individual bags from one another and the web.

A drawback of this process is that the web on the roll and supplied by the roll for each layer must be twice the height or length, depending upon the orientation of the bag in the web, of the finished plastic bag. It is also known to provide instead of two wide foil webs which are superposed, a flattened foil tube which, like the flat webs, is folded substantially midway along a longitudinal axis into a U shape. The further steps like forming holes serving as hand grips, inserting the tie and the like are practiced more or less as has been described with respect to the flat webs.

Whether one uses two parallel flat webs or a closed tubular web which is flattened and which has a comparatively large web width of the flattened webs, difficulties can be encountered in fabrication and handling of the webs. For example, the use of 2000 mm wide flat foil webs or a 2000 mm wide flattened foil tube for the production of double-layer plastic bags of 1000 mm in length present problems in fabrication. Such widths are difficult to be extruded, the extrusion apparatus required can be unduly costly and because the thickness can be 6 $\mu$mm to 8 $\mu$mm, such wide foils can only be handled and guided with difficulty. The earlier fabrication systems have had, therefore, only limited production speeds.

OBJECTS OF THE INVENTION

It is, therefore, the principal object of the present invention to provide an improved method of making plastic bags, namely multilayer and preferably double-wall plastic bags, especially tie bags, whereby the aforedescribed drawbacks are avoided.

Another object of the invention is to provide a method for the purposes described that simplifies the handling of the foils in the production of such bags and makes such handling problem-free.

Still another object of the invention is to provide a method of making multiwall and preferably double-wall plastic bags which is simplified by comparison with earlier methods and allows the highest possible quality of such bags to be produced at comparatively high production speeds.

SUMMARY OF THE INVENTION

These objects and others which will become apparent hereinafter are attained, in accordance with the invention in that a plurality, especially two, thermoplastic synthetic resin foil webs are supplied in respective double-layer webs by respective supply rolls and are unwound from the respective rolls at respective unwinding stations, are unfolded to single layer webs of the full web width from the half-width double-layer webs and are then superposed and fed to the bag-shaping stations at which the double-layer full width web is folded for forming the bags therein.

The advantage of the method of the invention is that in the extrusion process in producing the film, a smaller apparatus can be employed with reduced capital cost, greater reliability and a greater ability-to maintain the-uniformity of the extruded foils. A foil tube of a width, of, for example, 1000 mm is more easily extruded than, for example, a foil tube of a width of 2000 mm.

When the double-layer foil web is in the form of a flattened tube or tubular web, it can be split by a central longitudinal cut along one of the wall sides and the resulting flaps can be folded outwardly. The remaining walls of the tube and the two downwardly folded flaps are thus spread to form the full width foil which is superposed in a second full width foil made by slitting the other foil tube. The central slitting reduces the width of the flaps which must be unfolded by half in comparison to the width which would have to be unfolded if the slit would be provided along one of the edges of the flattened tube.

In addition, the central slit forms perfectly straight edges for the full width foil web, thereby greatly simplifying the superimposition of the two full width foil webs and the subsequent folding and processing to form the bags.

Advantageously, the tubular webs are supplied in the travel direction of the unfolded flattened full width webs with the foil webs being correspondingly deflected.

The tubular webs can also be fed substantially transversely to the travel direction of the unfolded foil webs and likewise guided over bars or rollers at which direction changes take place.

It is thus possible to unfold a plurality of half tubular or semi-tubular webs to form unfolded flattened members which are superposed and then folded into a kind of U to fabricate the plastic bags in a bag-making machine. In that case, the semi-tubular members may comprise two superposed walls which unitarily are connected along at least one edge and are unfolded without the need for slitting.

The method of the invention thus comprises the steps of:

(a) unwinding a plurality of double-layer substantially half-width foil webs from respective rolls and guiding the unwound double-layer substantially half-width foil webs along initial segments of a path;

(b) unfolding the double-layer substantially half-width foil webs along the initial segments into substantially full-width single-layer webs;

(c) superimposing one of the substantially full-width single-layer webs on at least one other of the substantially full-width single-layer webs coextensively to form a multilayer full-width web along a subsequent segment of the path;

(d) folding the multilayer full-width web generally in a U shape along a further segment of the path to form a folded multilayer web; and (e) forming bags in the folded multilayer web.

BRIEF DESCRIPTION OF THE DRAWING

The above and other objects, features, and advantages will become more readily apparent from the following description, reference being made to the accompanying drawing in which:

FIG. 1 is a perspective view diagrammatically illustrating one embodiment for the making of double-wall plastic bags from two rolled flattened thermoplastic synthetic resin foil tubes;

FIG. 2 shows a double-wall plastic bag formed as a tie bag in accordance with the invention;

FIG. 3 is a diagrammatic section taken along the line III—III of FIG. 1;

FIG. 4 is a diagrammatic section taken along the line IV—IV of FIG. 1;

SPECIFIC DESCRIPTION

Figure 5:
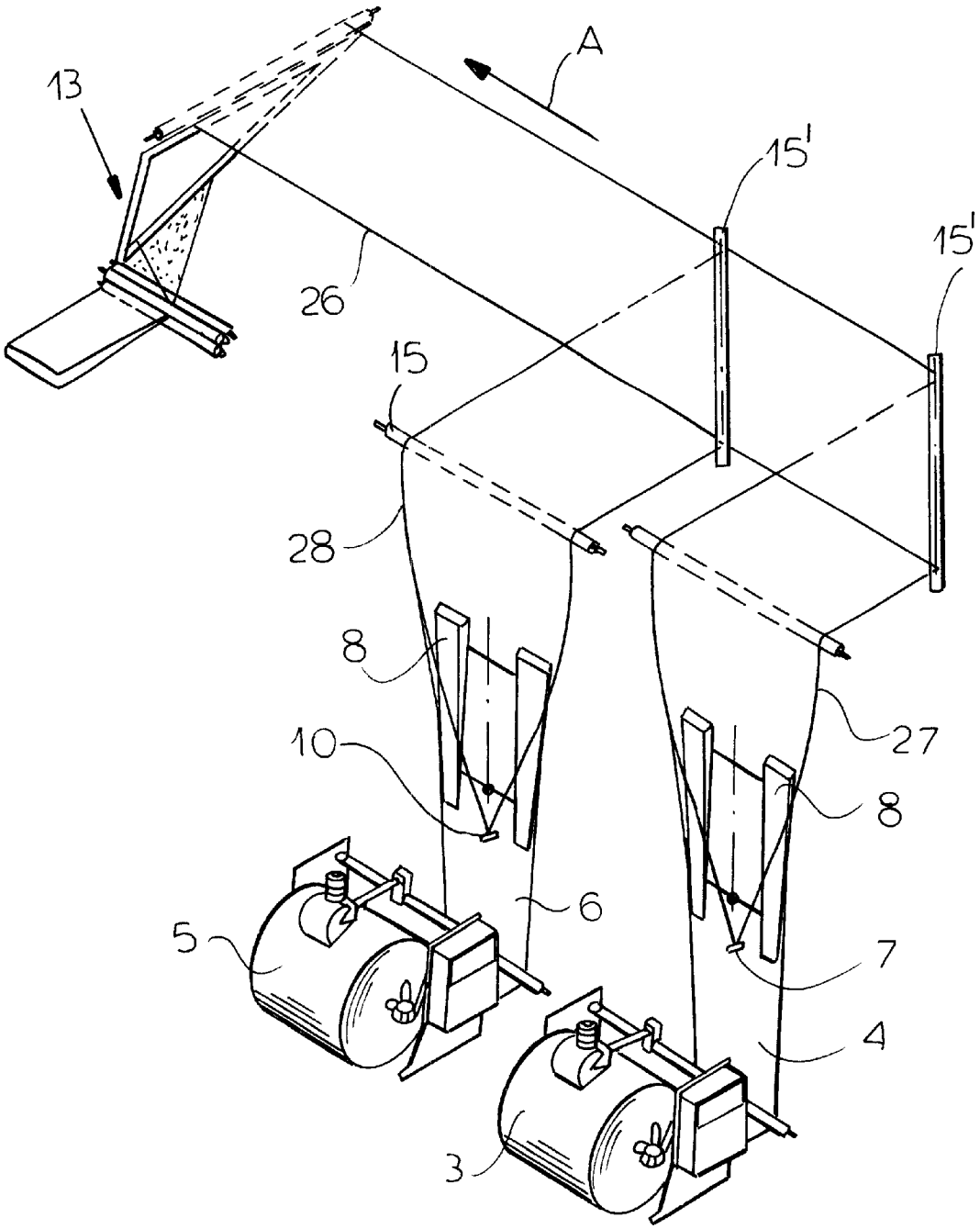
FIG. 5 is a view similar to FIG. 1 illustrating an alternative embodiment with respect to how the flattened tubes are fed.

In the embodiment of FIG. 1, the unwinding station 1 forms part of an apparatus intended to produce plastic bags 2, especially tie bags which can comprise front and rear panels 2*a* and 2*b*, each of two layers of thermoplastic synthetic resin foil, joined together at the bottom 2*c* and provided with lateral seams or welds 2*d*, for example. The tie 2*e* extends between the layers of foil at the mouth 2*f* of the bag. The apparatus for inserting the ties, forming the welds, perforating the bags between one another along the webs, etc., has been represented at 20 in FIG. 1.

The unwinding station 1 comprises an unwinding apparatus 21 for unwinding a tubular web 4 from a roll 3 and unwinding apparatus 22 for supplying a tubular web 6 which is unwound from a supply roll 5, the two unwinding apparatuses being horizontally spaced apart. The tubular surface 4 and 6 can each have a width of, for example, 1000 mm.

The tubular web 4 is slit along one of its sides by a central slit via the blade 7 so that each region 4*a* and 4*b* to either side of the slit can be unfolded to form a web 23 of the full width. To effect this unfolding operation, guides 8 are provided and the web passes over a direction-changing bar 9 located above the unwinding station. Similarly, the roll 5 which is spaced downstream of the roll 3 in the direction of travel of the webs, supplies the tubular foil web 6 to a slitting blade 10 which cuts through one face of the flattened tubular foil centrally and forms portions 6*a* and 6*b* which can be similarly unfolded as the web passes over the direction-changing bar 11. The full-width foil webs 23 and 24 are thus superposed so that they lie coextensively, one on the other.

The two superposed webs then pass via the folding triangle guide 13 of a folding unit 12 into a nip between rollers 25 to pass a folded travel layer web of half width at 14 to the bag-making portion 20 of the machine. The fold is generally of U shape as can be seen from FIG. 1. In FIG. 1, the webs are supplied by the rolls 3 and 5 and the tubular webs 4 and 6 in the travel direction of the superimposed webs 23 and 24 to the folding triangle 23 from which the folded web 14 passes transversely for further processing. In the embodiment of FIG. 5, however, in which the half-width flattened tubular webs 4 and 6 are supplied by two rolls 3 and 5 located side by side, the tubular webs 4 and 6 are fed transversely to the travel direction A of the superposed full width webs at 26, the webs 4 and 6 being slit at 7 and 10 by respective blades and being delivered at full-width webs 27 and 28 over horizontal guides 15 before passing before vertical guides 15' from which the superimposed 25 webs 26 are twisted into the horizontal plane for delivery to the folding triangle 13.

Figure 6:
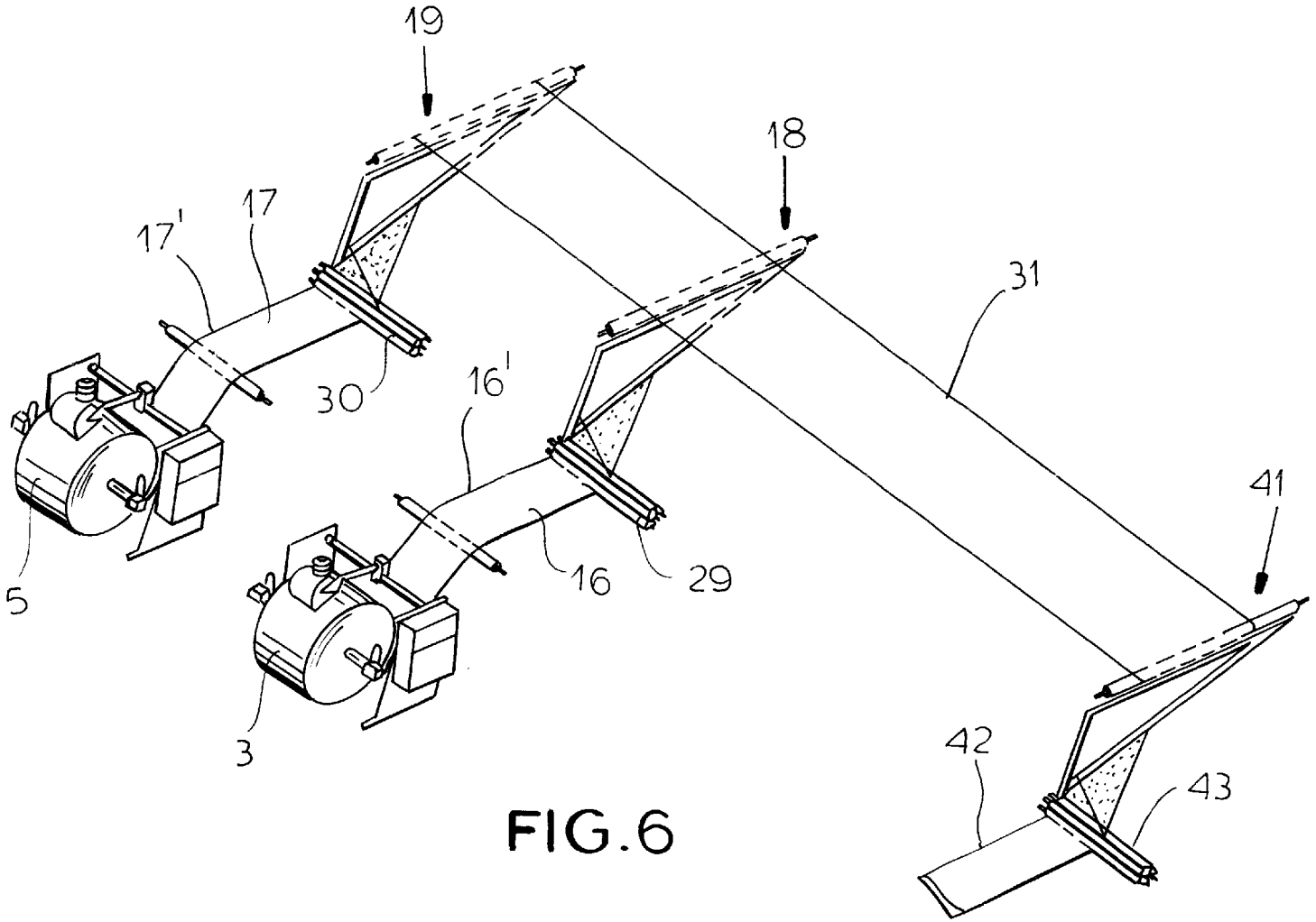
FIG. 6 is a view similar to FIG. 5 but illustrating the use of semi-tubes as the source of the foil webs for making the bags.

Another transverse feed arrangement characterizes FIG. 6 wherein, instead of tubular webs, semitubular webs 16 and 17 are delivered by the rolls 3 and 5 via respective unwinding devices to the guides 29 and 30 from which the webs 16 and 17 pass onto unfolding triangles 18 and 19 to form the superimposed full width web 31. The webs 16 and 17 have their upper and lower sides joined along the longitudinal edges 16' and 17' and are open along their opposite longitudinal edges. The semitubular webs 16 and 17 are here fed transversely to the superposed stretch 31. From the latter, the superposed webs are passed through the folding triangle 41 and emerge as the half-width U folded web 42 from the guide 43. The web 42 is fed to the bag-making apparatus structure schematically shown at 20 in FIG. 1.

The folding unit 41 corresponds generally to the folding units 13 of FIGS. 1 and 5. As a rule, the unwinding rolls of station 1 lie below the direction-change bars and rods and the folding triangles so that the half-width foil webs are fed upwardly from below and then substantially horizontally at an upper level. The individual unwinding rolls can deliver different foils if desired both as to the foil thickness and as to the material.

I claim:

1. A method of making multiwall plastic bags comprising the steps of:

(a) unwinding a plurality of double-layer substantially half-width foil webs from respective rolls and guiding the unwound double-layer substantially half-width foil webs along initial segments of a path;

(b) splitting a wall of each of said half-width foil webs and unfolding the double-layer substantially half-width foil webs along said initial segments into substantially full-width single-layer webs so that outer edges of said single-layer webs correspond to edges formed on splitting the half-width foil webs;

(c) superimposing one of said substantially full-width single-layer webs on at least one other of said substantially full-width single-layer webs coextensively to form a multilayer full-width web along a subsequent segment of said path;

(d) folding said multilayer full-width web generally in a U shape along a further segment of said path to form a folded multilayer web; and (e) forming bags in said folded multilayer web.

2. The method defined in claim 1 wherein two of said rolls are provided and the bags formed are double-wall bags.

3. The method defined in claim 2 wherein each of said half-width foil webs is a foil tube, further comprising the step of slitting each of said foil tubes along a side thereof substantially midway of the respective side and folding outwardly respective flaps formed by the slitting to a respective one of said full-width single-layer webs.

4. The method defined in claim 3 wherein slits are formed in said tubes as said tubes travel along said initial segment substantially vertically between the respective roll and said subsequent segment of said path, said subsequent segment lying above said roll.

5. The method defined in claim 4 wherein said tubes are fed generally in the same direction as said multilayer full-width web travels along said subsequent segment.

6. The method defined in claim 4 wherein said tubes travel substantially in a direction transverse to a direction of travel of said multilayer full-width web along said subsequent segment of said path.

7. The method defined in claim 6 wherein said full-width single-layer webs are guided around direction-change bars.

8. The method defined in claim 2 wherein said half-width foil webs are semitubular webs with sides connected along one longitudinal edge.

9. The method defined in claim 8 wherein said semitubular webs are guided upwardly to said subsequent segment from rolls located below said subsequent segment.

10. The method defined in claim 8 wherein said multilayer full-width segment lies in a substantially horizontal plane and said full-width single-layer webs are guided to said subsequent segment over direction-change bars.

11. The method defined in claim 1 wherein said subsequent segment lies in a substantially horizontal plane, said method further comprising the step of guiding said multilayer full-width web downwardly over a folding triangle to form said folded multilayer web in said further segment.

* * * * *